US011136977B2

(12) United States Patent
Nagulpelli et al.

(10) Patent No.: US 11,136,977 B2
(45) Date of Patent: Oct. 5, 2021

(54) COMPRESSOR HAVING OLDHAM KEYS

(71) Applicant: Emerson Climate Technologies, Inc., Sidney, OH (US)

(72) Inventors: Vinayak N. Nagulpelli, Pune (IN); Brian J. Knapke, Troy, OH (US); Daniel J. Knoth, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 214 days.

(21) Appl. No.: 16/404,124

(22) Filed: May 6, 2019

(65) Prior Publication Data

US 2020/0208632 A1 Jul. 2, 2020

(30) Foreign Application Priority Data

Dec. 31, 2018 (IN) ..... 201821049934

(51) Int. Cl.
*F04C 18/02* (2006.01)

(52) U.S. Cl.
CPC ..... *F04C 18/0215* (2013.01); *F04C 18/0207* (2013.01); *F04C 18/0246* (2013.01); *F04C 2240/50* (2013.01)

(58) Field of Classification Search
CPC ..... F04C 18/0215; F04C 2240/50; F04C 18/0207; F04C 18/0246; F04C 18/0253; F04C 2230/91; F01C 17/066
USPC ..... 418/55.1
See application file for complete search history.

(56) References Cited

U.S. PATENT DOCUMENTS

| | | | |
|---|---|---|---|
| 4,121,438 | A | 10/1978 | McCullough |
| 4,877,382 | A | 10/1989 | Caillat et al. |
| 4,992,033 | A | 2/1991 | Caillat et al. |
| 5,080,566 | A | 1/1992 | Sakata et al. |
| 5,099,658 | A | 3/1992 | Utter et al. |
| 5,141,417 | A | 8/1992 | Bush |
| 5,141,421 | A | 8/1992 | Bush et al. |

(Continued)

FOREIGN PATENT DOCUMENTS

| | | |
|---|---|---|
| AU | 780605-82 | 4/2005 |
| CN | 1219647 A | 6/1999 |

(Continued)

OTHER PUBLICATIONS

U.S. Appl. No. 15/252,579, filed Aug. 31, 2016, Paul L. Fullenkamp et al.

(Continued)

*Primary Examiner* — Connor J Tremarche
(74) *Attorney, Agent, or Firm* — Harness, Dickey & Pierce, P.L.C.

(57) ABSTRACT

A compressor may include a non-orbiting scroll, an orbiting scroll, a bearing housing and first and second discrete keys. The non-orbiting scroll may include a first end plate having a first spiral wrap extending therefrom. The orbiting scroll may include a second end plate having a second spiral wrap extending therefrom and meshingly engaged with the first spiral wrap of the non-orbiting scroll. The bearing housing may support the orbiting scroll. Each of the first and second keys may be slidably engaged in first slots formed in the second end plate of the orbiting scroll and slidably engaged in second slots formed in the first end plate of the non-orbiting scroll or third slots formed in the bearing housing.

24 Claims, 9 Drawing Sheets

(56) References Cited

U.S. PATENT DOCUMENTS

| | | | | |
|---|---|---|---|---|
| 5,178,526 | A | 1/1993 | Galante et al. | |
| 5,219,281 | A | 6/1993 | Caillat et al. | |
| 5,275,543 | A | 1/1994 | Tanaka et al. | |
| 5,320,506 | A | 6/1994 | Fogt | |
| 5,330,334 | A | 7/1994 | Bush et al. | |
| 5,382,144 | A | 1/1995 | Tanaka et al. | |
| 5,403,172 | A | 4/1995 | Blass et al. | |
| 5,407,335 | A | 4/1995 | Caillat et al. | |
| 5,538,408 | A | 7/1996 | Blass et al. | |
| 5,582,512 | A | 12/1996 | Bush | |
| 5,704,773 | A | 1/1998 | Higashiyama | |
| 5,842,845 | A | 12/1998 | Kawano et al. | |
| 5,897,306 | A | 4/1999 | Beck | |
| 6,106,252 | A | 8/2000 | Yamanaka et al. | |
| 6,139,295 | A | 10/2000 | Utter et al. | |
| 6,146,118 | A | 11/2000 | Haller et al. | |
| 6,231,324 | B1 | 5/2001 | Clendenin et al. | |
| 6,261,072 | B1 | 7/2001 | Abe et al. | |
| 6,439,867 | B1 | 8/2002 | Clendenin | |
| 6,546,816 | B2 | 4/2003 | Schlabach | |
| 6,752,606 | B2 | 6/2004 | Koo | |
| 6,776,593 | B1 * | 8/2004 | Cho | F04C 18/0215 418/55.3 |
| 7,014,438 | B2 | 3/2006 | Fukuda et al. | |
| 7,182,586 | B2 | 2/2007 | Kim et al. | |
| 7,661,938 | B2 | 2/2010 | Ginies et al. | |
| 7,717,687 | B2 | 5/2010 | Reinhart | |
| 7,736,137 | B2 | 6/2010 | Ueno et al. | |
| 7,918,658 | B2 | 4/2011 | Bush et al. | |
| 8,057,202 | B2 | 11/2011 | Haller | |
| 8,096,792 | B2 | 1/2012 | Suefuji et al. | |
| 8,157,550 | B2 | 4/2012 | Kudo | |
| 8,177,534 | B2 | 5/2012 | Ni | |
| 8,186,980 | B2 | 5/2012 | Komai et al. | |
| 8,241,022 | B2 | 8/2012 | Nakajima | |
| 8,262,377 | B2 | 9/2012 | Caillat et al. | |
| 8,287,257 | B2 | 10/2012 | Dunaevsky | |
| 8,303,280 | B2 | 11/2012 | Kiyokawa et al. | |
| 8,356,987 | B2 | 1/2013 | Guo et al. | |
| 8,393,882 | B2 | 3/2013 | Ignatiev et al. | |
| 8,651,842 | B2 | 2/2014 | Yamamoto et al. | |
| 8,864,479 | B2 | 10/2014 | Watts et al. | |
| 8,931,759 | B2 | 1/2015 | Bonanno et al. | |
| 8,967,986 | B2 | 3/2015 | Harashima et al. | |
| 9,017,050 | B2 | 4/2015 | Ginies et al. | |
| 9,169,841 | B2 | 10/2015 | Bonnefoi et al. | |
| 9,181,949 | B2 | 11/2015 | Duppert et al. | |
| 9,316,223 | B2 | 4/2016 | Unami et al. | |
| 9,322,404 | B2 | 4/2016 | Roof et al. | |
| 9,347,441 | B2 | 5/2016 | Rice et al. | |
| 9,534,599 | B2 | 1/2017 | Rosson et al. | |
| 10,400,770 | B2 | 9/2019 | Fullenkamp et al. | |
| 11,002,275 | B2 | 5/2021 | Fullenkamp et al. | |
| 2008/0085204 | A1 | 4/2008 | Lifson | |
| 2008/0119294 | A1 | 5/2008 | Erikson et al. | |
| 2009/0317276 | A1 | 12/2009 | Lee et al. | |
| 2011/0044833 | A1 | 2/2011 | Dunaevsky | |
| 2011/0081264 | A1 * | 4/2011 | Ishizono | F04C 23/02 417/410.5 |
| 2014/0178228 | A1 | 6/2014 | Rosson et al. | |
| 2014/0369819 | A1 | 12/2014 | Yamashita et al. | |
| 2015/0037190 | A1 | 2/2015 | Smerud et al. | |
| 2015/0260189 | A1 | 9/2015 | Kato | |
| 2016/0115954 | A1 | 4/2016 | Doepker et al. | |
| 2016/0123326 | A1 * | 5/2016 | Fogt | F01C 1/0215 418/55.3 |
| 2016/0230764 | A1 | 8/2016 | Tatsuwaki et al. | |
| 2016/0238006 | A1 | 8/2016 | Rosson et al. | |
| 2017/0067466 | A1 | 3/2017 | Oh et al. | |
| 2017/0234313 | A1 | 8/2017 | Fullenkamp et al. | |
| 2019/0383289 | A1 | 12/2019 | Fullenkamp et al. | |

FOREIGN PATENT DOCUMENTS

| | | | |
|---|---|---|---|
| CN | 1515799 | A | 7/2004 |
| CN | 206668549 | U | 11/2017 |
| JP | S6388288 | A | 4/1988 |
| JP | H02227581 | A | 9/1990 |
| JP | H04330392 | A | 11/1992 |
| JP | H0587063 | A | 4/1993 |
| JP | H05223068 | A | 8/1993 |
| JP | H0610853 | A | 1/1994 |
| JP | H06088579 | A | 3/1994 |
| JP | 2000337272 | A | 12/2000 |
| KR | 20170029313 | A | 3/2017 |

OTHER PUBLICATIONS

Office Action regarding U.S. Appl. No. 16/555,413, dated Sep. 24, 2020.

Offfice Action regarding Chinese Patent Application No. 201710083894.9, dated Aug. 27, 2019. Translation provided by Unitalen Attorneys at Law.

Office Action regarding European Patent Application No. 17156102.0, dated Feb. 26, 2020.

Office Action regarding Indian Patent Application No. 201821049934, dated Aug. 10, 2020.

Search Report regarding European Patent Application No. 17156102.0, dated Jul. 24, 2017.

Office Action regarding Chinese Patent Application No. 201710083894.9, dated Jun. 4, 2018. Translation provided by Unitalen Attorneys at Law.

Office Action regarding U.S. Appl. No. 15/252,579, dated Jun. 26, 2018.

Office Action regarding U.S. Appl. No. 15/252,579, dated Dec. 20, 2018.

Office Action regarding Chinese Patent Application No. 201710083894.9, dated Feb. 27, 2019. Translation provided by Unitalen Attorneys at Law.

Notice of Allowance regarding U.S. Appl. No. 15/252,579, dated Jun. 20, 2019.

Notice of Allowance regarding U.S. Appl. No. 16/555,413, dated Feb. 3, 2021.

* cited by examiner

COMPRESSOR HAVING OLDHAM KEYS

CROSS-REFERENCE TO RELATED APPLICATIONS

This application claims the benefit and priority of Indian Patent Application No. 201821049934, filed Dec. 31, 2018. The entire disclosure of the above application is incorporated herein by reference.

FIELD

The present disclosure relates to a compressor having Oldham keys.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a non-orbiting scroll, an orbiting scroll, a bearing housing and first and second discrete keys. The non-orbiting scroll may include a first end plate having a first spiral wrap extending therefrom. The orbiting scroll may include a second end plate having a second spiral wrap extending therefrom and meshingly engaged with the first spiral wrap of the non-orbiting scroll. The bearing housing may support the orbiting scroll. Each of the first and second keys may be slidably engaged in first slots formed in the second end plate of the orbiting scroll and slidably engaged in second slots formed in the first end plate of the non-orbiting scroll or third slots formed in the bearing housing.

In some configurations of the above paragraph, each of the first and second keys are slidably engaged in the first slots formed in the second end plate of the orbiting scroll and slidably engaged in the second slots formed in the first end plate of the non-orbiting scroll.

In some configurations of any one or more of the above paragraphs, the first and second keys extend through the first slots and the second slots.

In some configurations of any one or more of the above paragraphs, longitudinal axes of the first slots and longitudinal axes of the second slots are 90 degrees apart.

In some configurations of any one or more of the above paragraphs, a driveshaft engages the orbiting scroll and drives the orbiting scroll in an orbital path relative to the non-orbiting scroll.

In some configurations of any one or more of the above paragraphs, the first and second keys translate in the second slots formed in the first end plate of the non-orbiting scroll as the orbiting scroll is driven in the orbital path.

In some configurations of any one or more of the above paragraphs, the first slots are positioned below the second slots.

In some configurations of any one or more of the above paragraphs, each of the first and second keys includes a first member and a second member. The first member is slidably engaged in a respective first slot formed in the second end plate of the orbiting scroll and the second member is slidably engaged in a respective second slot formed in the first end plate of the non-orbiting scroll.

In some configurations of any one or more of the above paragraphs, the first member and the second member are coated with a material having a high lubricity.

In some configurations of any one or more of the above paragraphs, at least one of the first member and the second member is coated with a material having a high lubricity.

In some configurations of any one or more of the above paragraphs, each of the first and second keys are slidably engaged in the first slots formed in the second end plate of the orbiting scroll and slidably engaged in the third slots formed in a surface of the bearing housing.

In some configurations of any one or more of the above paragraphs, longitudinal axes of the first slots and longitudinal axes of the third slots are 90 degrees apart.

In some configurations of any one or more of the above paragraphs, a driveshaft engages the orbiting scroll and drives the orbiting scroll in an orbital path relative to the non-orbiting scroll.

In some configurations of any one or more of the above paragraphs, the first and second keys translate in the third slots formed in the surface of the bearing housing as the orbiting scroll is driven in the orbital path.

In some configurations of any one or more of the above paragraphs, the first slots are positioned above the third slots.

In some configurations of any one or more of the above paragraphs, each of the first and second keys includes a first member and a second member. The first member is slidably engaged in a respective first slot formed in the second end plate of the orbiting scroll and the second member is slidably engaged in a respective third slot formed in the surface of the bearing housing.

In some configurations of any one or more of the above paragraphs, the second member has a thickness that is thicker than a thickness of the first member.

In some configurations of any one or more of the above paragraphs, at least one of the first member and the second member is coated with a material having a high lubricity.

In another form, the present disclosure provides a compressor that may include a non-orbiting scroll, an orbiting scroll, a driveshaft, a bearing housing and first and second discrete keys. The non-orbiting scroll includes a first end plate having a first spiral wrap extending therefrom. The orbiting scroll includes a second end plate having a second spiral wrap extending therefrom and meshingly engaged with the first spiral wrap of the non-orbiting scroll. The driveshaft engages the orbiting scroll and drives the orbiting scroll in an orbital path relative to the non-orbiting scroll. The bearing housing supports the orbiting scroll and defines a thrust bearing surface. Each of the first and second keys are slidably engaged in first slots formed in the second end plate of the orbiting scroll and are slidably engaged in second slots formed in a surface of the bearing housing. The first and second keys are permitted to translate in the second slots as the driveshaft drives the orbiting scroll in the orbital path.

In some configurations of the above paragraph, the first and second key are X-shaped.

In some configurations of any one or more of the above paragraphs, longitudinal axes of the first slots and longitudinal axes of the second slots are 90 degrees apart.

In some configurations of any one or more of the above paragraphs, the first slots are positioned above the second slots.

In some configurations of any one or more of the above paragraphs, the each of the first and second keys includes a first member and a second member. The first member is slidably engaged in a respective first slot formed in the second end plate of the orbiting scroll and the second member is slidably engaged in a respective second slot formed in the surface of the bearing housing.

In some configurations of any one or more of the above paragraphs, the first member may extend radially inwardly from a middle portion of a surface of the second member.

In some configurations of any one or more of the above paragraphs, at least one of the first member and the second member is coated with a material having a high lubricity.

In some configurations of any one or more of the above paragraphs, the second member has a thickness that is thicker than a thickness of the first member.

In yet another form, the present disclosure provides a compressor that includes a non-orbiting scroll, an orbiting scroll, a bearing housing, a bracket plate and first and second discrete keys. The non-orbiting scroll includes a first end plate having a first spiral wrap extending therefrom. The orbiting scroll includes a second end plate having a second spiral wrap extending therefrom and meshingly engaged with the first spiral wrap of the non-orbiting scroll. The bearing housing supports the orbiting scroll. The bracket plate is fixed to the bearing housing. Each of the first and second keys are slidably received in first slots formed in the second end plate of the orbiting scroll and are slidably engaged in second slots formed in the bracket plate.

In some configurations of the above paragraph, the longitudinal axes of the first slots and the longitudinal axes of the second slots are 90 degrees apart.

In some configurations of any one or more of the above paragraphs, the first slots are positioned above the second slots.

In some configurations of any one or more of the above paragraphs, each of the first and second keys includes a first member and a second member. The first member is slidably engaged in a respective first slot formed in the second end plate of the orbiting scroll and the second member is slidably engaged in a respective second slot formed in the bracket plate.

In some configurations of any one or more of the above paragraphs, the first member extends radially inwardly from a middle portion of a surface of the second member.

In some configurations of any one or more of the above paragraphs, the second member has a thickness that is thicker than a thickness of the first member.

In some configurations of any one or more of the above paragraphs, at least one of the first member and the second member is coated with a material having a high lubricity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
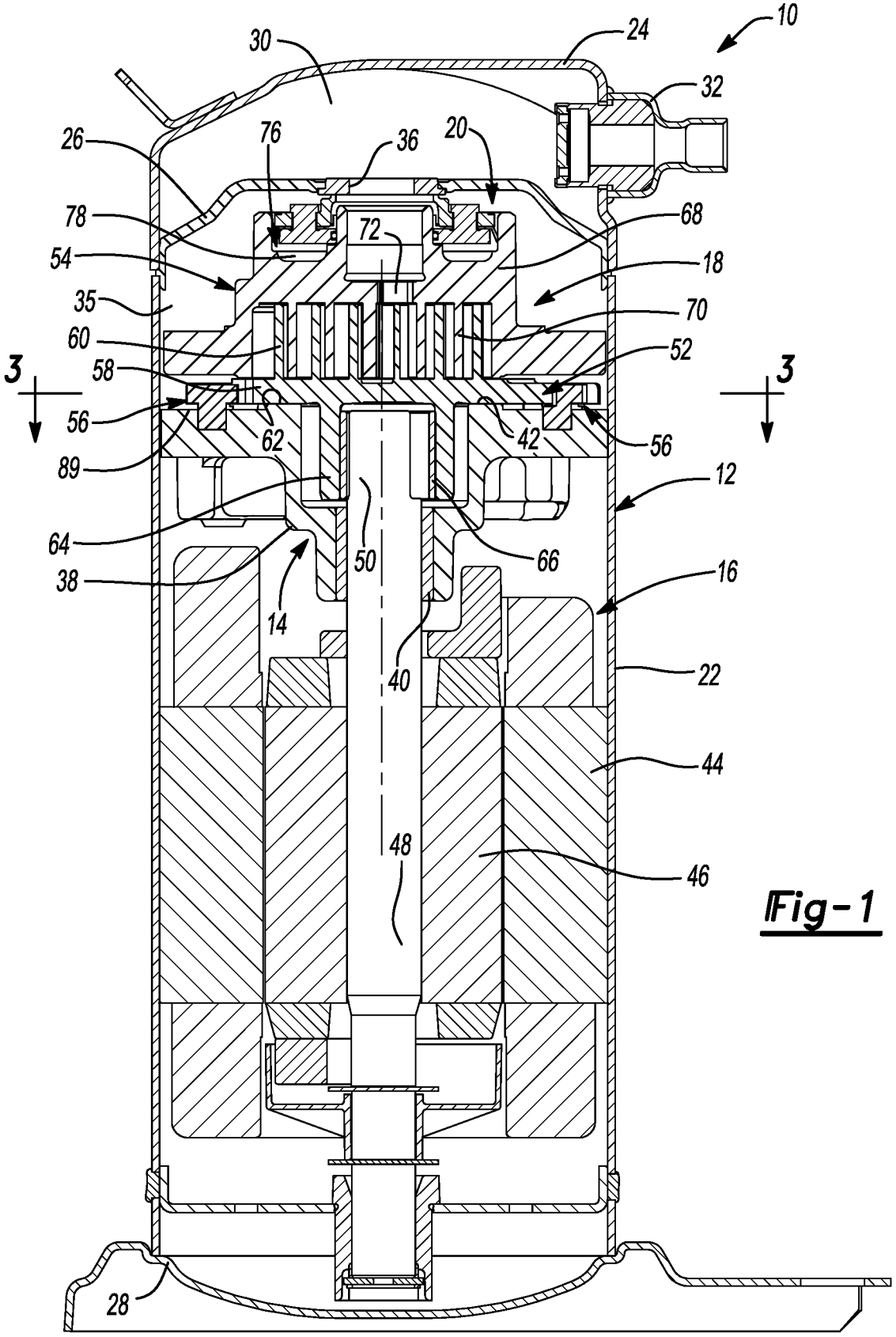
FIG. 1 is a cross-sectional view of a compressor having Oldham keys according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a bearing housing assembly 14, a motor assembly 16, a compression mechanism 18, and a seal assembly 20. The shell assembly 12 may generally form a compressor housing and may include a cylindrical shell 22, an end cap 24 at the upper end thereof, a transversely extending partition 26, and a base 28 at a lower end thereof. The end cap 24 and partition 26 may generally define a discharge chamber 30. A discharge fitting 32 may be attached to the shell assembly 12 at an opening in the end cap 24. A suction gas inlet fitting (not shown) may be attached to the shell assembly 12 at another opening and may communicate with a suction chamber 35 defined by the shell 22 and the partition 26. The partition 26 may include a discharge passage 36 therethrough providing communication between the compression mechanism 18 and the discharge chamber 30.

The bearing housing assembly 14 may be affixed to the shell 22 and may include a main bearing housing 38 and a bearing 40. The main bearing housing 38 may house the bearing 40 therein and may define an annular flat thrust bearing surface 42 on an axial end surface thereof.

The motor assembly 16 may include a motor stator 44, a rotor 46, and a driveshaft 48. The motor stator 44 may be press fit into the shell 22. The driveshaft 48 may be rotatably driven by the rotor 46 and may be rotatably supported within the bearing 40. The rotor 46 may be press fit on the driveshaft 48. The driveshaft 48 may include an eccentric crankpin 50.

The compression mechanism 18 may generally include an orbiting scroll 52, a non-orbiting scroll 54 and Oldham keys 56. The orbiting scroll 52 may include an end plate 58 having a spiral wrap 60 on the upper surface thereof and an annular flat thrust surface 62 on the lower surface. The thrust surface 62 may interface with the annular flat thrust bearing surface 42 on the main bearing housing 38. A cylindrical hub 64 may project downwardly from the thrust surface 62 and may have a drive bushing 66 rotatably disposed therein. The drive bushing 66 may include an inner bore in which the crank pin 50 is drivingly disposed. A flat surface of the crankpin 50 may drivingly engage a flat surface in a portion of the inner bore of the drive bushing 66 to provide a radially compliant driving arrangement.

The non-orbiting scroll 54 may include an end plate 68 and a spiral wrap 70 projecting downwardly from the end plate 68. The spiral wrap 70 may meshingly engage the spiral wrap 60 of the orbiting scroll 52, thereby creating a series of moving fluid pockets. The fluid pockets defined by the spiral wraps 60, 70 may decrease in volume as they move from a radially outer position (at a suction pressure) to a radially intermediate position (at an intermediate pressure) to a radially inner position (at a discharge pressure) throughout a compression cycle of the compression mechanism 18.

The end plate 68 may include a discharge passage 72 and an annular recess 76. The discharge passage 72 is in communication with one of the fluid pockets at the radially inner position and allows compressed working fluid (e.g., at the discharge pressure) to flow into the discharge chamber 30. The annular recess 76 may receive the seal assembly 20 and cooperate with the seal assembly 20 to define an axial biasing chamber 78 therebetween. The biasing chamber 78 receives fluid from the fluid pocket in the intermediate position through an intermediate passage (not shown). A pressure differential between the intermediate-pressure fluid in the biasing chamber 78 and fluid in the suction chamber 35 exerts an axial biasing force on the non-orbiting scroll 54 urging the non-orbiting scroll 54 toward the orbiting scroll 52 to sealingly engage the scrolls 52, 54 with each other.

Figure 2:
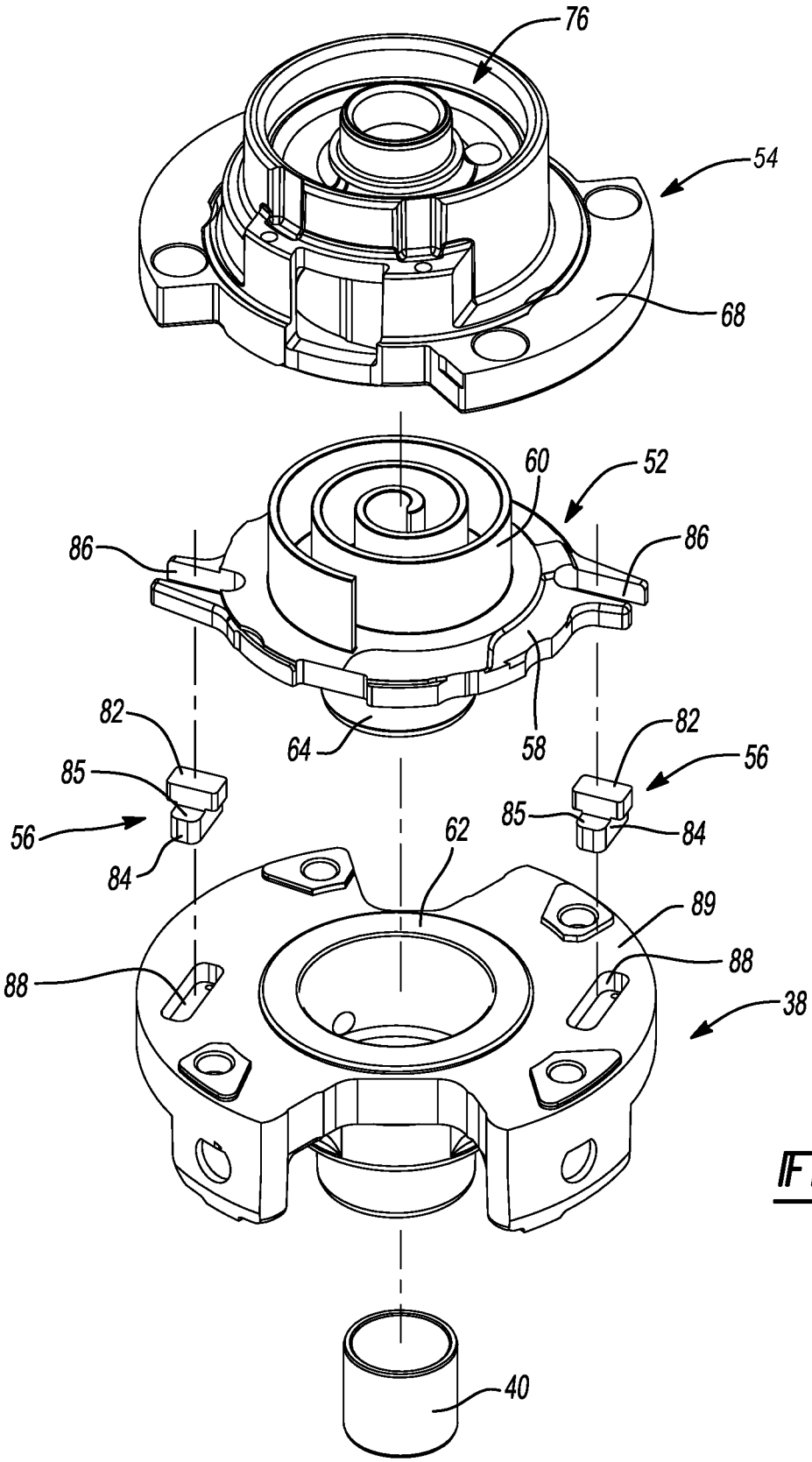
FIG. 2 is an exploded view of a compression mechanism and a main bearing housing of the compressor of FIG. 1.

As shown in FIG. 2, the Oldham keys 56 may be generally X-shaped and may include a first member 82 and a second member 84 extending perpendicular to the first member 82. The keys 56 are separate and discrete components (i.e., the keys 56 are not integrally formed with or fixedly attached to a ring, unlike conventional Oldham rings). The first member 82 may extend in a direction perpendicular to a rotational axis of the driveshaft 48 from a middle portion of a surface 85 of the second member 84. The first member 82 may slidably engage slots (keyways) 86 formed in the end plate 58 of the orbiting scroll 52, and the second member 84 may slidably engage slots (keyways) 88 formed in a surface 89 (i.e., positioned below the thrust surface 62 of the main bearing housing 38) of the main bearing housing 38. In this way, the keys 56 prevent rotation of the orbiting scroll 52 relative to the non-orbiting scroll 54 while allowing orbital movement of the orbiting scroll 52 relative to the non-orbiting scroll 54. Stated another way, the second member 84 of the keys 56 slides (or translates) within the slots 88 of the main bearing housing 38 as the orbiting scroll 52 orbits, thereby restricting the orbiting scroll 52 from rotating. The thickness of the second member 84 may be thicker than the thickness of the first member 82. In some configurations, the thickness of the first member 82 may be thicker than the thickness of the second member 84.

Figure 3:
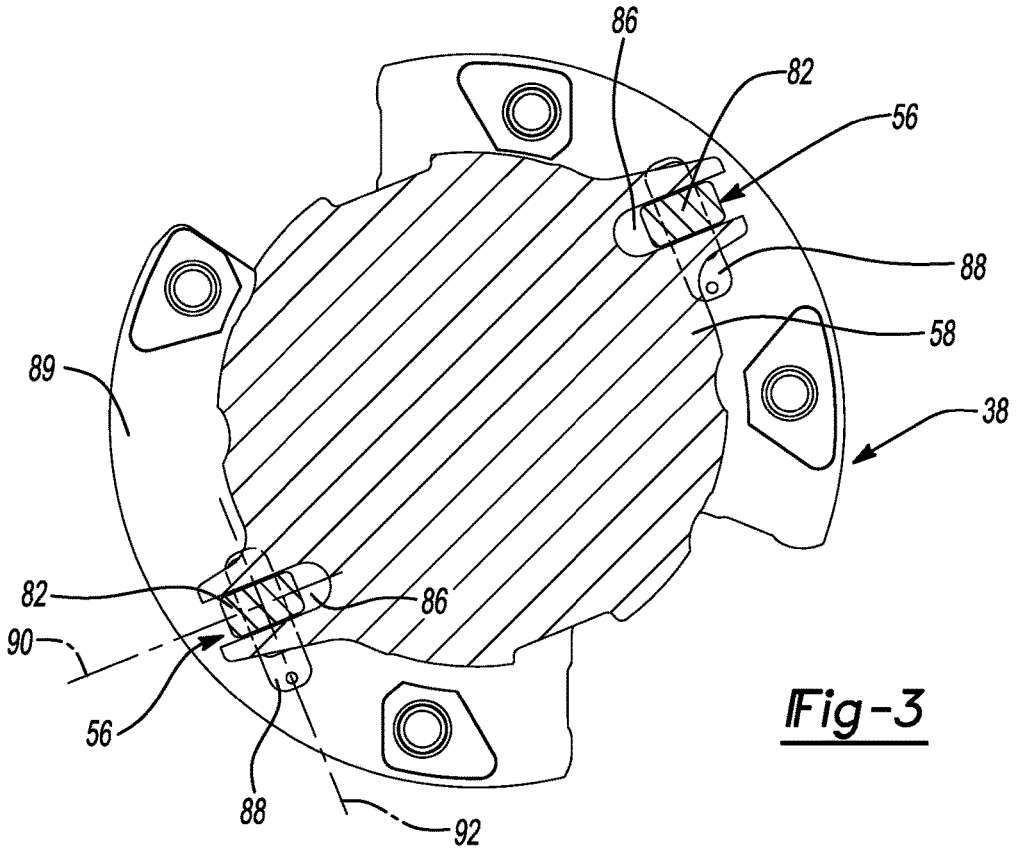
FIG. 3 is a cross-sectional view of the compressor taken along line 3-3 of FIG. 1.
Figure 4:
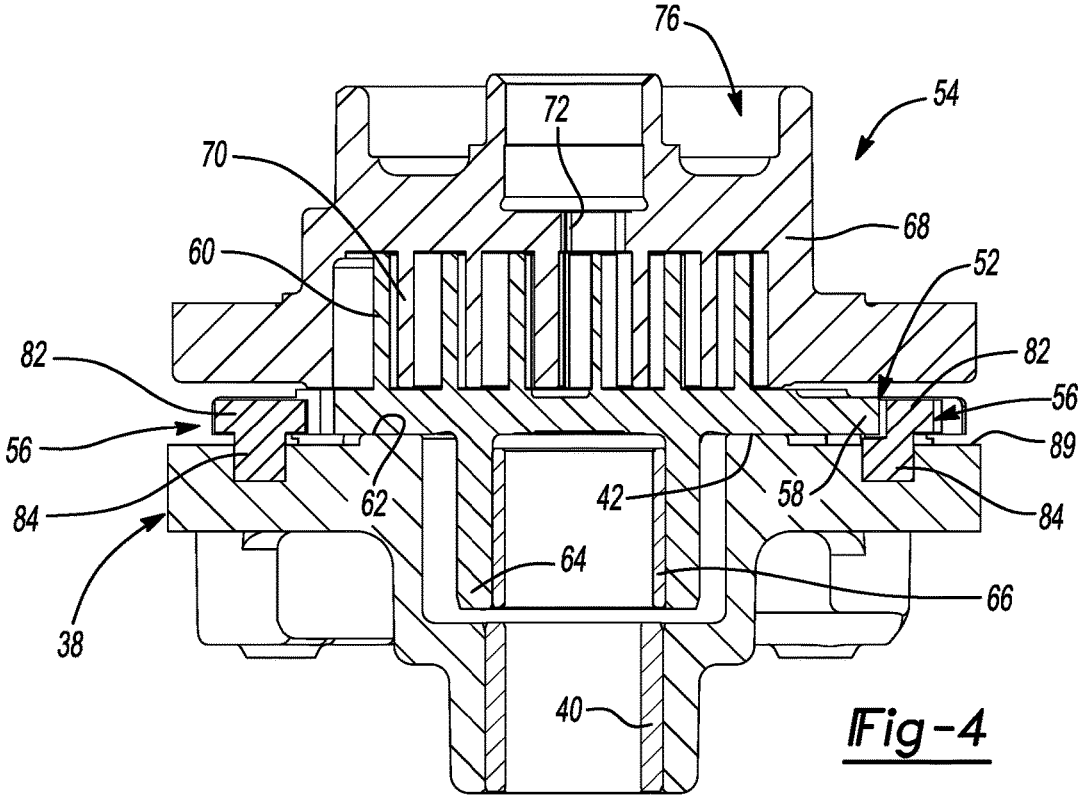
FIG. 4 is a cross-sectional view of the main bearing housing, the compression mechanism and the Oldham keys of the compressor of FIG. 1.

As shown in FIG. 3, longitudinal axes 90 of the slots 86 formed in the end plate 58 of the orbiting scroll 52 are angled (e.g., 90 degrees) from longitudinal axes 92 of the slots 88 formed in the surface 89 of the main bearing housing 38. The slots 86 of the orbiting scroll 52 are positioned above the slots 88 of the main bearing housing 38.

In some configurations, the first and/or second members 82, 84 may be coated or made entirely from a material or materials that have a high lubricity and/or are less prone to wear. Such materials may include Vespel® (i.e., polymide containing graphite; manufactured by DuPont), bronze (e.g., bismuth bronze, bronze with graphite, bronze with silicone, etc.), aluminum bronze, cast iron, ceramic, polyarletherketone (PAEK) group materials (e.g., resins including polyetheretherketone (PEEK), polyetherketone (PEK), polyetheretheretherketone (PEEEK), polyetherketoneketone (PEKK), polyetheretherketoneketone (PEEKK), polyetherketoneetheretherketone (PEKEEK), polyetheretherketoneetheretherketone (PEEKEEK), or combinations thereof), polyamideimide (PAI) (e.g., Torlon®, manufactured by Solvay), polyphenylene sulfide (PPS), or polyphthalamide (PPA), for example, or other materials with high lubricity.

One of the benefits of the keys 56 of the present disclosure is the reduced friction (i.e., due to the elimination of the Oldham coupling) during operation of the compressor relative to compressors having conventional Oldham couplings with a ring integrally formed with keys. This reduction of frictions improves the efficiency of the compressor. Also, the keys 56 provide cost advantages to manufacture as compared to manufacturing the Oldham coupling, for example.

Figure 5:
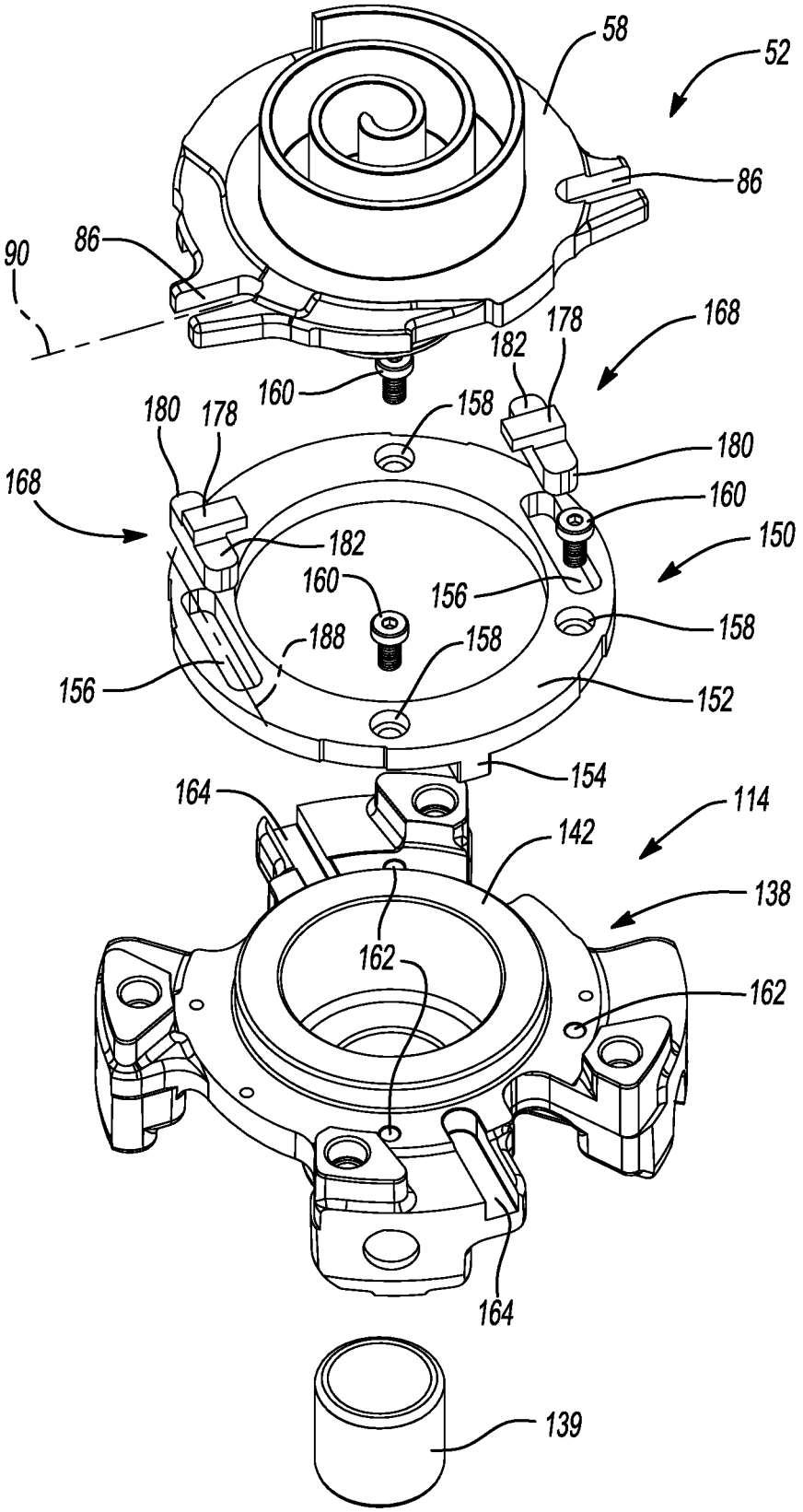
FIG. 5 is an exploded view of an orbiting scroll of the compression mechanism and the Oldham keys of FIG. 2 with an alternate main bearing housing.
Figure 6:
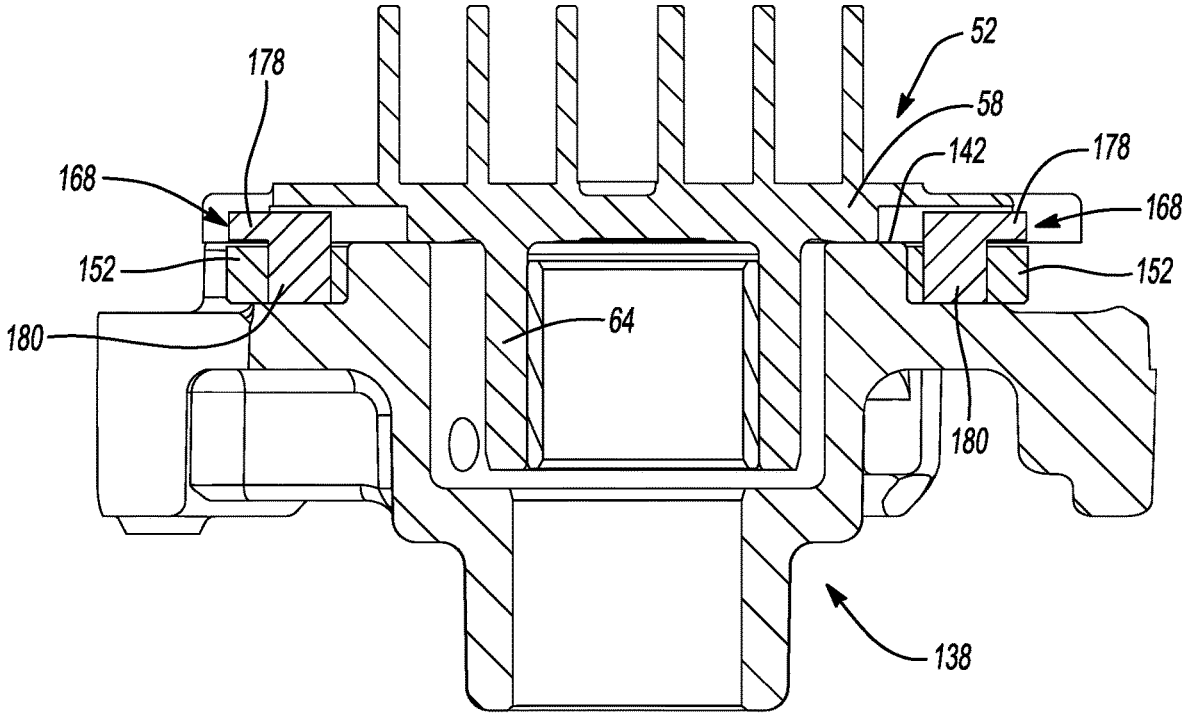
FIG. 6 is a cross-sectional view of the orbiting scroll, the Oldham keys and the alternate main bearing housing of FIG. 5.

With reference to FIGS. 5 and 6, another bearing housing assembly 114 and Oldham keys 168 are provided that may be incorporated into the compressor 10 instead of the bearing housing assembly 14 and Oldham keys 56, respectively, described above. The structure and function of the bearing housing assembly 114 and the Oldham keys 168 may be similar or identical to that of the bearing housing assembly 14 and Oldham keys 56, respectively, described above, apart from any exceptions noted below.

The bearing housing assembly 114 may be affixed to the shell 22 and may include a main bearing housing 138 and a bearing 139. The main bearing housing 138 may house the bearing 139 therein and may define an annular flat thrust bearing surface 142 on an axial end surface thereof.

A bracket plate 150 may be attached to the bearing housing 138 and may include an annular body 152 and protrusions 154 (only one shown in FIG. 5). The body 152 may include slots 156 and apertures 158 formed therein. Fasteners 160 may extend through the apertures 158 in the body 152 and apertures 162 in the bearing housing 138, thereby attaching the bracket plate 150 to the bearing housing 138. The protrusions 154 may extend from the body 152 in an axial direction (i.e., in a direction parallel to a rotational axis of the driveshaft 48). The protrusions 154 may be received in slots 164 formed in the bearing housing 138, thereby rotationally fixing the bracket plate 150 to the bearing housing 138 and properly positioning the bracket plate 150 to the bearing housing 138. It is understood that the bracket plate 150 allows an operator (not shown) to retrofit traditional bearing housings so as to include the Oldham keys as described herein. Longitudinal axes of the slots 156 are parallel to longitudinal axes of the slots 164.

The Oldham keys 168 may be generally T-shaped and may include a first member 178 and a second member 180. The first member 178 may extend radially inwardly (i.e., in a direction perpendicular to a rotational axis of the driveshaft 48) from a middle portion of a surface 182 of the second member 180. The first member 178 may slidably engage the slots (keyways) 86 formed in the end plate 58 of the orbiting scroll 52, and the second member 180 may slidably engage the slots 156 formed in the body 152 of the bracket plate 150. In this way, the keys 168 prevent rotation of the orbiting scroll 52 relative to the main bearing housing 138 while allowing orbital movement of the orbiting scroll 52 relative to the main bearing housing 138. Stated another way, the second member 180 of the keys 168 slides (or translates) within the slots 156 of the bracket plate 150 as the orbiting scroll 52 orbits, thereby restricting the orbiting scroll 52 from rotating. The thickness of the second member 180 is thicker than the thickness of the first member 178. In some configurations, the thickness of the first member 178 may be thicker than the thickness of the second member 180.

Longitudinal axes 90 of the slots 86 formed in the end plate 58 of the orbiting scroll 52 are angled (e.g., 90 degrees) from longitudinal axes 188 of the slots 156 formed in the body 152 of the bracket plate 150. The slots 86 of the orbiting scroll 52 are above the slots 156 of the bracket plate 150.

In some configurations, the first and/or second members 178, 180 may be coated or made entirely from a material or materials that have a high lubricity and/or are less prone to wear. Such materials may include Vespel® (i.e., polymide containing graphite; manufactured by DuPont), bronze (e.g., bismuth bronze, bronze with graphite, bronze, with silicone, etc.), aluminum bronze, cast iron, ceramic, polyarletherketone (PAEK) group materials (e.g., resins including polyetheretherketone (PEEK), polyetherketone (PEK), polyetheretheretherketone (PEEEK), polyetherketoneketone (PEKK), polyetheretherketoneketone (PEEKK), polyetherketoneetheretherketone (PEKEEK), polyetheretherketoneetheretherketone (PEEKEEK), or combinations thereof), polyamideimide (PAI) (e.g., Torlon®, manufactured by Solvay), polyphenylene sulfide (PPS), or polyphthalamide (PPA), for example, or other materials with high lubricity.

Figure 7:
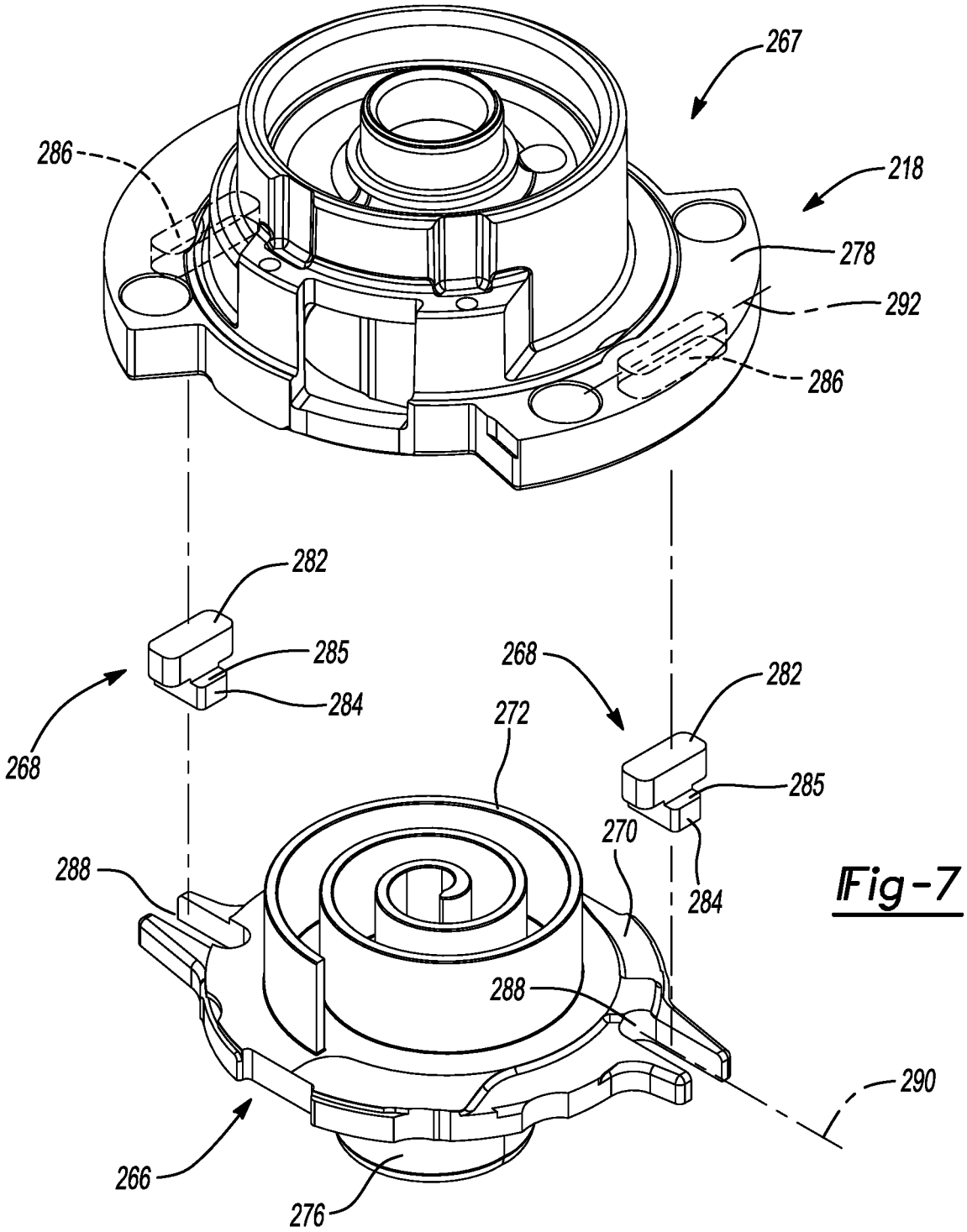
FIG. 7 is an exploded view of another alternate compression mechanism.
Figure 8:
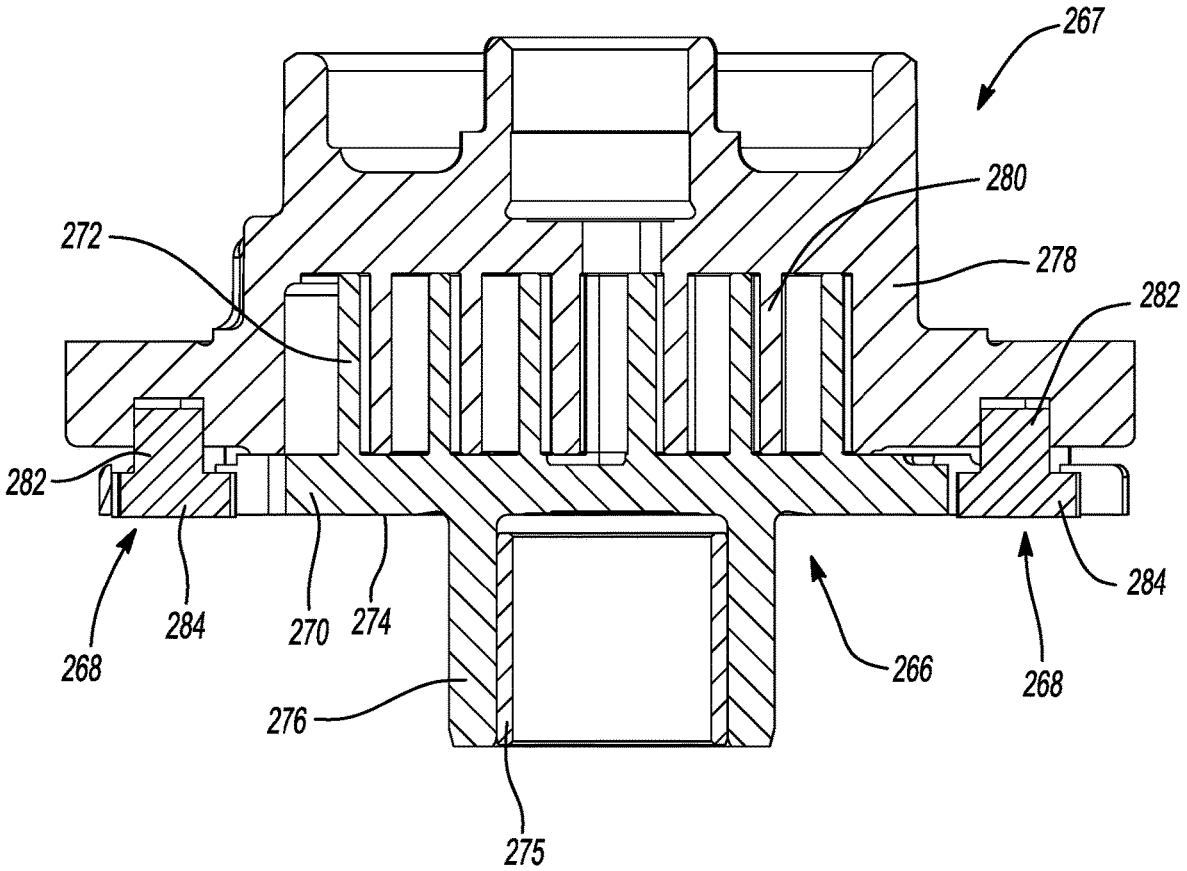
FIG. 8 is a cross-sectional view of the compression mechanism of FIG. 7.

With reference to FIGS. 7 and 8, another compression mechanism 218 is provided. The compression mechanism 218 may be incorporated into the compressor 10 instead of the compression mechanism 18 described above. The structure and function of the compression mechanism 218 may be similar or identical to that of the compression mechanism 18 described above, apart from any exceptions noted below.

The compression mechanism 218 may generally include an orbiting scroll 266, a non-orbiting scroll 267 and Oldham keys 268. The orbiting scroll 266 may include an end plate 270 having a spiral wrap 272 on the upper surface thereof and an annular flat thrust surface 274 on the lower surface. The thrust surface 274 may interface with the annular flat thrust bearing surface 42 on the main bearing housing 38. A cylindrical hub 276 may project downwardly from the thrust surface 274 and may have a drive bushing 275 rotatably disposed therein. The drive bushing 275 may include an inner bore in which the crank pin 50 is drivingly disposed. The flat surface of the crankpin 50 may drivingly engage a flat surface in a portion of the inner bore of the drive bushing to provide a radially compliant driving arrangement. The non-orbiting scroll 267 may include an end plate 278 and a spiral wrap 280 projecting downwardly from the end plate 278. The spiral wrap 280 may meshingly engage the spiral wrap 272 of the orbiting scroll 266, thereby creating a series of moving fluid pockets.

The Oldham keys 268 may be generally X-shaped and may include a first member 282 and a second member 284 extending perpendicular to the first member 282. The first member 282 may extend in a direction perpendicular to a rotational axis of the driveshaft 48 from a middle portion of a surface 285 of the second member 284. The first member 282 may slidably engage slots (keyways) 286 formed in the end plate 278 of the non-orbiting scroll 276, and the second member 284 may slidably engage slots (keyways) 288 formed in the end plate 270 of the orbiting scroll 266. In this way, the keys 268 prevent rotation of the orbiting scroll 266 relative to the non-orbiting scroll 267 while allowing orbital movement of the orbiting scroll 266 relative to the non-orbiting scroll 267. Stated another way, the first member 282 of the keys 268 slides (or translates) within the slots 286 of the non-orbiting scroll 267 as the orbiting scroll 266 orbits, thereby restricting the orbiting scroll 266 from rotating. The thickness of the first member 282 is thicker than the thickness of the second member 284. In some configurations, the thickness of the second member 284 may be thicker than the thickness of the first member 282.

Longitudinal axes 290 of the slots 288 formed in the end plate 270 of the orbiting scroll 266 are angled (e.g., 90 degrees) from longitudinal axes 292 of the slots 286 formed in the end plate 278 of the non-orbiting scroll 267. The slots 288 of the orbiting scroll 266 are positioned below the slots 286 of the non-orbiting scroll 267.

In some configurations, the first and/or second members 282, 284 may be coated or made entirely from a material or materials that have a high lubricity and/or less are prone to wear. Such materials may include Vespel® (i.e., polymide containing graphite; manufactured by DuPont), bronze (e.g., bismuth bronze, bronze with graphite, bronze with silicone, etc.), aluminum bronze, cast iron, ceramic, polyarletherketone (PAEK) group materials (e.g., resins including polyetheretherketone (PEEK), polyetherketone (PEK), polyetheretheretherketone (PEEEK), polyetherketoneketone (PEKK), polyetheretherketoneketone (PEEKK), polyetherketoneetheretherketone (PEKEEK), polyetheretherketoneetheretherketone (PEEKEEK), or combinations thereof), polyamideimide (PAI) (e.g., Torlon®, manufactured by Solvay), polyphenylene sulfide (PPS), or polyphthalamide (PPA), for example, or other materials with high lubricity.

Figure 9:
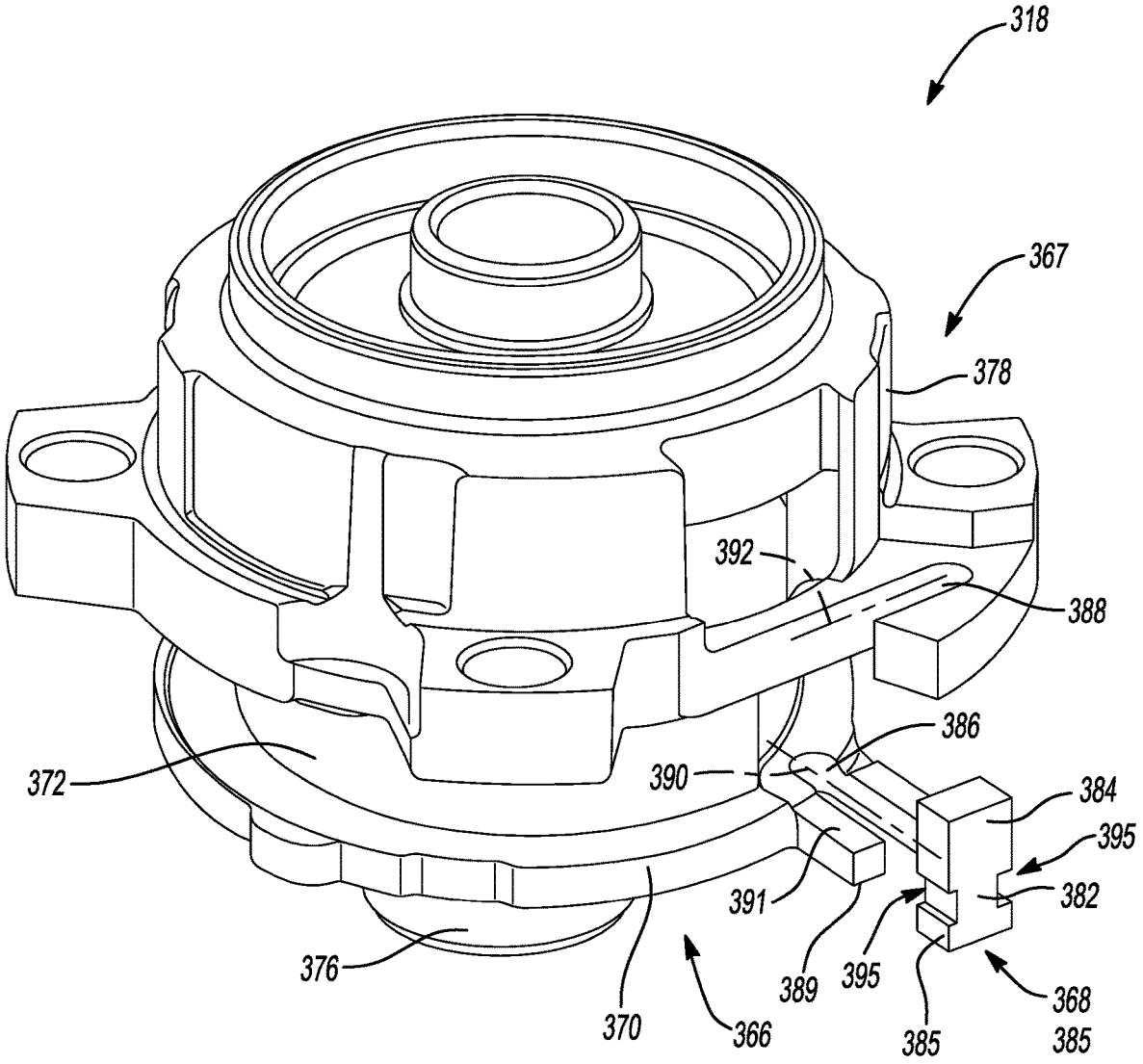
FIG. 9 is an exploded view of another alternate compression mechanism and Oldham key.
Figure 10:
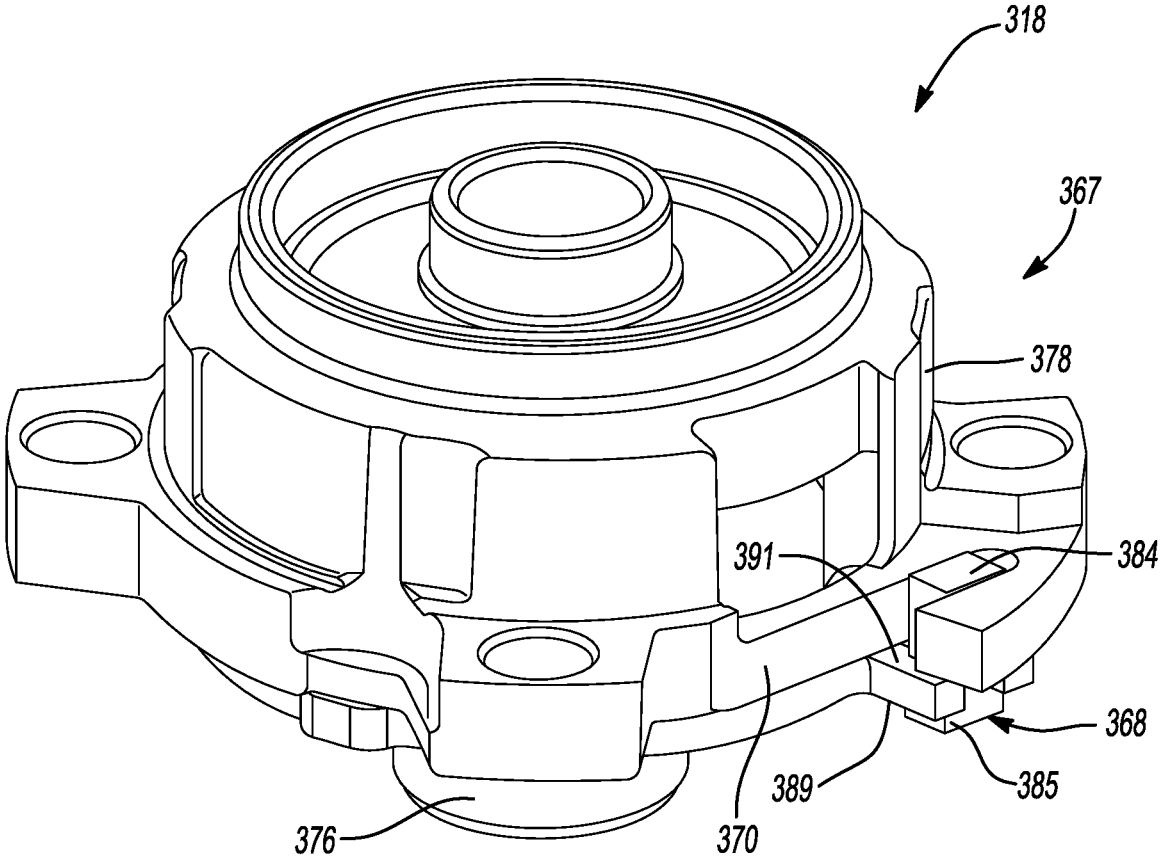
FIG. 10 is a perspective view of the compression mechanism and Oldham key of FIG. 9.

With reference to FIGS. 9 and 10, another compression mechanism 318 is provided. The compression mechanism 318 may be incorporated into the compressor 10 instead of the compression mechanisms 18, 218 described above. The structure and function of the compression mechanism 318 may be similar or identical to that of the compression mechanisms 18, 218 described above, apart from any exceptions noted below.

The compression mechanism 318 may generally include an orbiting scroll 366, a non-orbiting scroll 367 and Oldham keys 368 (only one shown in FIGS. 9 and 10). The orbiting scroll 366 may include an end plate 370 having a spiral wrap 372 on the upper surface thereof and an annular flat thrust surface (not shown) on the lower surface. The thrust surface (not shown) may interface with the annular flat thrust bearing surface 42 on the main bearing housing 38. A cylindrical hub 376 may project downwardly from the thrust surface and may have a drive bushing (not shown) rotatably disposed therein. The drive bushing may include an inner bore in which the crank pin 50 is drivingly disposed. The flat surface of the crankpin 50 may drivingly engage a flat surface in a portion of the inner bore of the drive bushing to provide a radially compliant driving arrangement. The non-orbiting scroll 367 may include an end plate 378 and a spiral wrap (not shown) projecting downwardly from the end plate 378. The spiral wrap may meshingly engage the spiral wrap 372 of the orbiting scroll 366, thereby creating a series of moving fluid pockets.

Each key 368 (only one shown in FIGS. 9 and 10) may include a first portion or member 382, a second portion or member 384 and an end portion 385. The first portion 382 may have a width that is narrower than a width of the second portion 384 and the end portion 385. The first portion 382 may include slots 395 formed in opposing lateral sides thereof. The slots 395 slidably receive the end plate 370 of the orbiting scroll 366 when the first portion 382 slidably engage slots 386 (keyways; only one shown in FIG. 9) formed in the end plate 370 of the orbiting scroll 366. The second portion 384 may slidably engage slots 388 (keyways; only one shown in FIG. 9) formed in the end plate 378 of the non-orbiting scroll 367. In this way, the keys 368 prevent rotation of the orbiting scroll 366 relative to the non-orbiting scroll 367 while allowing orbital movement of the orbiting scroll 366 relative to the non-orbiting scroll 367. Stated another way, the second portion 384 of the keys 368 slides (or translates) within the slots 388 of the non-orbiting scroll 367 as the orbiting scroll 366 orbits, thereby restricting the orbiting scroll 366 from rotating. The end portion 385 may abut against a bottom surface 389 of the end plate 370 of the orbiting scroll 366 and the second portion 384 may abut against a top surface 391 of the end plate 370 of the orbiting scroll 366. In this way, the keys 368 are prevented from moving in the axial direction (i.e., direction parallel to a rotational axis of the driveshaft 48).

Longitudinal axes 390 of the slots 386 formed in the end plate 370 of the orbiting scroll 366 are angled (e.g., 90 degrees) from longitudinal axes 392 of the slots 388 formed in the end plate 378 of the non-orbiting scroll 367. The slots 386 of the orbiting scroll 366 are positioned below the slots 388 of the non-orbiting scroll 367.

In some configurations, the keys 368 may be coated or made entirely from a material or materials that have a high lubricity and/or are less prone to wear. Such materials may include Vespel® (i.e., polymide containing graphite; manufactured by DuPont), bronze (e.g., bismuth bronze, bronze with graphite, bronze with silicone, etc.), aluminum bronze, cast iron, ceramic, polyarletherketone (PAEK) group materials (e.g., resins including polyetheretherketone (PEEK), polyetherketone (PEK), polyetheretheretherketone (PEEEK), polyetherketoneketone (PEKK), polyetheretherketoneketone (PEEKK), polyetherketoneetheretherketone (PEKEEK), polyetheretherketoneetheretherketone (PEEKEEK), or combinations thereof), polyamideimide (PAI) (e.g., Torlon®, manufactured by Solvay), polyphenylene sulfide (PPS), or polyphthalamide (PPA), for example, or other materials with high lubricity.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a non-orbiting scroll including a first end plate having a first spiral wrap extending therefrom;

an orbiting scroll including a second end plate having a second spiral wrap extending therefrom and meshingly engaged with the first spiral wrap of the non-orbiting scroll, the second end plate having a first slot and a second slot;

a bearing housing assembly supporting the orbiting scroll; and first and second discrete keys that are unattached from each other and are not integrally formed with each other, wherein the first key is slidably engaged in the first slot and slidably engaged in a third slot formed in: the first end plate of the non-orbiting scroll or the bearing housing assembly, and wherein the second key is slidably engaged in the second slot and slidably engaged in a fourth slot formed in: the first end plate of the non-orbiting scroll or the bearing housing assembly.

2. The compressor of claim 1, wherein the third and fourth slots are formed in the first end plate of the non-orbiting scroll.

3. The compressor of claim 2, wherein the first key extends at least partially into the first and third slots and the second key extends at least partially into the second and fourth slots.

4. The compressor of claim 3, wherein longitudinal axes of the first and second slots are angled at 90 degrees relative to longitudinal axes of the third and fourth slots.

5. The compressor of claim 3, further comprising a driveshaft engaging the orbiting scroll and driving the orbiting scroll in an orbital path relative to the non-orbiting scroll.

6. The compressor of claim 5, wherein the first key translates in the third slot formed in the first end plate of the non-orbiting scroll as the orbiting scroll is driven in the orbital path, and wherein the second key translates in the fourth slot formed in the first end plate of the non-orbiting scroll as the orbiting scroll is driven in the orbital path.

7. The compressor of claim 2, wherein the first and second slots are positioned below the third and fourth slots.

8. The compressor of claim 2, wherein each of the first and second keys includes a first member and a second member, wherein the first member of the first key is slidably engaged in the first slot formed in the second end plate of the orbiting scroll and the second member of the first key is slidably engaged in the third slot formed in the first end plate of the non-orbiting scroll, and wherein the first member of the second key is slidably engaged in the second slot formed in the second end plate of the orbiting scroll and the second member of the second key is slidably engaged in the fourth slot formed in the first end plate of the non-orbiting scroll.

9. The compressor of claim 8, wherein at least one of the first member and the second member of each of the first and second keys is coated.

10. The compressor of claim 1, wherein the third and fourth slots are formed in the bearing housing assembly.

11. The compressor of claim 10, wherein the bearing housing assembly includes a bracket, and wherein the third and fourth slots are formed in the bracket.

12. The compressor of claim 10, wherein longitudinal axes of the first and second slots are angled at 90 degrees relative to longitudinal axes of the third and fourth slots.

13. The compressor of claim 10, further comprising a driveshaft engaging the orbiting scroll and driving the orbiting scroll in an orbital path relative to the non-orbiting scroll.

14. The compressor of claim 13, wherein the first key translates in the third slot formed in the surface of the bearing housing assembly as the orbiting scroll is driven in the orbital path, and wherein the second key translates in the fourth slot formed in the surface of the bearing housing assembly as the orbiting scroll is driven in the orbital path.

15. The compressor of claim 10, wherein the first and second slots are positioned above the third and fourth slots.

16. The compressor of claim 10, wherein each of the first and second keys includes a first member and a second member, wherein the first member of the first key is slidably engaged in the first slot formed in the second end plate of the orbiting scroll and the second member of the first key is slidably engaged in the third slot formed in the surface of the bearing housing assembly, and wherein the first member of the second key is slidably engaged in the second slot formed in the second end plate of the orbiting scroll and the second member of the second key is slidably engaged in the fourth slot formed in the surface of the bearing housing assembly.

17. The compressor of claim 16, wherein at least one of the first member and the second member of each of the first and second keys is coated.

18. A compressor comprising:

a non-orbiting scroll including a first end plate having a first spiral wrap extending therefrom;

an orbiting scroll including a second end plate having a second spiral wrap extending therefrom and meshingly engaged with the first spiral wrap of the non-orbiting scroll, the second end plate having a first slot and a second slot;

a driveshaft engaging the orbiting scroll and driving the orbiting scroll in an orbital path relative to the non-orbiting scroll;

a bearing housing supporting the orbiting scroll, the bearing housing having a third slot and a fourth slot; and first and second discrete keys that are unattached from each other and are not integrally formed with each other, wherein the first key is slidably engaged in the first slot and slidably engaged in the third slot, wherein the first key is configured to translate in the third slot as the driveshaft drives the orbiting scroll in the orbital path, wherein the second key is slidably engaged in the second slot and slidably engaged in the fourth slot, and wherein the second key is configured to translate in the fourth slot as the driveshaft drives the orbiting scroll in the orbital path.

19. The compressor of claim 18, wherein the first and second keys are X-shaped.

20. The compressor of claim 18, wherein longitudinal axes of the first and second slots are angled at 90 degrees relative to longitudinal axes of the third and fourth slots.

21. The compressor of claim 20, wherein the first and second slots are positioned above the third and fourth slots.

22. The compressor of claim 18, wherein each of the first and second keys includes a first member and a second member, wherein the first member of the first key is slidably engaged in the first slot formed in the second end plate of the orbiting scroll and the second member of the first key is slidably engaged in the third slot formed in the bearing housing, and wherein the first member of the second key is slidably engaged in the second slot formed in the second end plate of the orbiting scroll and the second member of the second key is slidably engaged in the fourth slot formed in the bearing housing.

23. The compressor of claim 22, wherein the first member of the first key extends radially inwardly from a middle portion of a surface of the second member of the first key, and wherein the first member of the second key extends radially inwardly from a middle portion of a surface of the second member of the second key.

24. The compressor of claim 23, wherein at least one of the first member and the second member of each of the first and second keys is coated.

* * * * *